US012721408B2

(12) United States Patent
Inami

(10) Patent No.: US 12,721,408 B2
(45) Date of Patent: Sep. 1, 2026

(54) STRUCTURE OF PORTABLE COIN HOLDER

(71) Applicant: Masayuki Inami

(72) Inventor: Masayuki Inami, Kanagawa (JP)

( * ) Notice: Subject to any disclaimer, the term of this patent is extended or adjusted under 35 U.S.C. 154(b) by 0 days.

(21) Appl. No.: 19/068,521

(22) Filed: Mar. 3, 2025

(65) Prior Publication Data

US 2025/0194766 A1 Jun. 19, 2025

Related U.S. Application Data

(63) Continuation of application No. PCT/JP2023/030531, filed on Aug. 24, 2023.

(30) Foreign Application Priority Data

Sep. 9, 2022 (JP) ..... 2022-144207

(51) Int. Cl.
*A45C 1/10* (2006.01)

(52) U.S. Cl.
CPC ..... *A45C 1/10* (2013.01); *A45C 2001/107* (2013.01)

(58) Field of Classification Search
CPC ..... A45C 1/10; A45C 2001/107
USPC ..... 206/0.8, 0.84
See application file for complete search history.

(56) References Cited

U.S. PATENT DOCUMENTS 954,589 A * 4/1910 Reizenstein ..... A45C 1/10 453/54
3,028,949 A * 4/1962 Sohosky ..... A45C 1/10 206/0.83
3,731,695 A * 5/1973 Meijer ..... A45C 1/10 453/54
4,540,008 A * 9/1985 Murphy ..... G07D 1/08 453/18
5,499,710 A * 3/1996 Hoffman ..... A45C 1/02 206/0.81

(Continued)

FOREIGN PATENT DOCUMENTS

DE 20209828 U1 9/2002
JP 47-12351 Y1 5/1972

(Continued)

OTHER PUBLICATIONS

International Search Report (PCT/ISA/210) issued by the International Searching Authority on Sep. 26, 2023 in corresponding International Application No. PCT/JP2023/030531.

(Continued)

*Primary Examiner* — Jacob K Ackun
(74) *Attorney, Agent, or Firm* — Sughrue Mion, PLLC

(57) ABSTRACT

Coin storage parts are provided on a front side and a back side of a coin holder to increase the number of storage parts, and make the number of coins stored in each of the coin storage parts approximately half. A structure is adopted in which a coin is pushed out in an operational opening space provided on a side opposite to an aperture for placing the coin into the coin storage part and taking out the coin from the coin storage part, thereby ensuring sufficient operability. A movement of the coin in the coin storage part is prevented by incorporating an O-ring or the like. Since the number of coins stored per one coin storage part is as small as about 2 to 4 coins and the storage part has a shallow depth, it is easy to guide and prevent the movement of the coins.

2 Claims, 2 Drawing Sheets

(56) References Cited

U.S. PATENT DOCUMENTS

| | | | | |
|---|---|---|---|---|
| 6,302,777 | B1 * | 10/2001 | Zoldan | A45C 1/10 453/54 |
| 6,318,547 | B1 * | 11/2001 | Pianezzola | A45C 1/02 206/0.81 |
| 7,083,512 | B2 * | 8/2006 | Auguste, Jr. | A45C 1/02 206/0.8 |
| 2002/0195354 | A1 * | 12/2002 | Davis, Jr. | A45C 1/10 206/0.83 |
| 2005/0167288 | A1 * | 8/2005 | Sottile | A44B 15/005 206/38.1 |
| 2006/0011494 | A1 * | 1/2006 | Squadroni | A45C 1/10 206/0.8 |
| 2025/0194765 | A1 * | 6/2025 | Willis | A45C 1/10 |

FOREIGN PATENT DOCUMENTS

| | | | |
|---|---|---|---|
| JP | 53-90510 | U | 7/1978 |
| JP | 8-10021 | A | 1/1996 |
| JP | 2004-321646 | A | 11/2004 |
| JP | 3215510 | U | 3/2018 |

OTHER PUBLICATIONS

Written Opinion (PCT/ISA/237) issued by the International Searching Authority on Sep. 26, 2023 in corresponding International Application No. PCT/JP2023/030531.

* cited by examiner

STRUCTURE OF PORTABLE COIN HOLDER

CROSS-REFERENCE TO RELATED APPLICATIONS

This is a continuation of International Application No. PCT/JP2023/030531 filed on Aug. 24, 2023, and claims priority from Japanese Patent Application No. 2022-144207 filed on Sep. 9, 2022, the entire content of which is incorporated herein by reference.

TECHNICAL FIELD

The present invention relates to a structure of a portable coin holder.

BACKGROUND ART

A portable coin holder has a structure capable of holding all types of coins by type, excluding at least a coin infrequently used, among those generally in circulation, and allowing the coins to be taken out by type.

A portable coin holder usually has a plurality of spaces in which coins can be stored in a stacked state by type. An aperture for placing a coin into the space and taking out the coin from the space is provided with a stopper made of an elastic material such as rubber or a spring so that the coin can be held inside and easily taken out, or the aperture expands in accordance with insertion and removal of the coin due to elastic deformation of a storage part.

In the portable type, it is important to reduce the overall size, and therefore, storage parts for various coins are arranged with as few gaps as possible (for example, see the document of Utility Model JP3215510Y Registered in Japan). FIG. 1 shows an example of a coin holder of the related art.

When a coin is placed into a storage part of a general portable coin holder, a force may be applied only in a direction of pushing and moving an end portion of the coin, but in order to take out the coin, a force applied in a moving direction, an operation of holding the coin with a finger, and a force required therefor are also required. Specifically, these methods include catching both sides of the coin by fingers, pinching and pulling the coin, strongly pressing on one side thereof, holding the coin by a frictional force between the finger and the coin surface, pushing the coin out, or the like. When the frictional force between the coin and the finger is used, the operation feeling greatly changes depending on a state of the finger, for example, dry fingers can make the coin more slippery. The operation and force required in directions other than the moving direction complicate the operation and increase a required operation force.

The coin holder is required to have a holding force with which a coin is not easily taken out from the storage part at the time of storing the coin and to be easy to take in and out the coin, but in a simple means using rubber or a spring used for the portable coin holder, there is an aspect that the force required for taking in and out the coin increases as the holding force increases. The increased operating force required for complex operations makes it difficult to achieve both.

In the structure of FIG. 1, there is one coin storage part for each type of coin, and the total thickness of various coins needs to be the substantially same in a case where the maximum number of coins are stored due to restrictions on a case structure. Therefore, the number of stored coins cannot be determined based on the frequency of use, and a large number of coins with low frequency of use are held, which leads to an increase in the overall size. For example, in Japan, the frequency of use of 5, 50 and 500 yen coins is lower than those of 1, 10 and 100 yen coins. In addition, when determining the number of coins to be stored, it is necessary to consider that the coin thickness is different for each type, and in the United States, the 10 cent coin thickness is as thin as 1.35 mm while the 5 cent coin thickness is 1.95 mm.

If all coins of one type are stacked in one place like in an existing coin holder, the thickness increases and the storage part also becomes deeper in a thickness direction accordingly. As the storage part becomes deeper, the maximum tilt angle increases (an angle at which the coin tilts inside the storage part increases) when there are only a few stored coins, for example, when only one coin remains, and thus fluctuation in the substantial effective width of the coin (the width of the coin in a plan view) also increases. Since it is necessary to consider the case where the coin is pulled out from the storage part as described above, when the storage part is deep, the design of the case and the stopper becomes more difficult as compared with the case where the storage part is shallow.

An existing coin holder usually requires an individual stopper for each coin type as shown in FIG. 1, resulting in a complex structure.

SUMMARY OF INVENTION

In the present invention, as shown in FIGS. 2 and 3, an operational opening space 4 is provided on a side opposite to an aperture 2 for placing a coin into a storage part 1 or taking out the coin from the storage part 1, and the coin is taken out by pushing out the coin from the operational opening space 4, thereby it is possible to eliminate or reduce the need for operations and forces such as picking up, pinching, and holding the coin by friction with fingers. A portable coin holder according to the present invention includes a coin holder body 9, and upper and lower plates 5 covering front and back surfaces of the coin holder body 9 in a thickness direction thereof. The operational opening space 4 is formed by a through hole penetrating the upper and lower plates 5. In order to push out the coin from the operational opening space 4, it is preferable that an end portion of the coin stored in the storage part 1 on a side opposite to the aperture 2 is exposed.

Further, separate storage parts are provided on a front side and a back side of the coin holder body 9, the number of storage parts is approximately doubled (as the number of storage parts in the thickness direction of the coin holder body 9) and the number of coins stored per storage part is approximately half, thereby it is possible to make each storage part shallow and prevent an increase in the overall thickness. The storage parts on the front side and the back side of the coin holder body 9 are partitioned by a partition plate 8 disposed at a substantially intermediate portion in the thickness direction of the coin holder body 9. That is, the coin storage parts 1 are formed between the partition plate 8 and the upper and lower plates 5 arranged with a space from the partition plate 8. By making the storage part shallow, it is not necessary to put the finger deeply into a pushing operation space. Further, since the storage part has a shallow depth, the tilt of the coin in the storage part is further limited, and the fluctuation in the substantial effective width of the coin is reduced, so that design of the stopper and the like becomes easy.

In the portable coin holder, it is necessary to prevent the coin from rattling in the storage part. FIGS. 2 and 3 show a structure for preventing the movement of coins using O-rings 7. The O-rings 7 are inserted into a body portion (partition plate 8) and holes of the upper and lower plates 5 to be restricted in position. With this structure, coins can be easily accommodated in the storage part 1 along a shape of the O-ring 7 (an inner diameter shape of the O-ring 7). The single O-ring 7 can also be used as a stopper for a plurality of storage parts. That is, the O-ring 7 is disposed on at least one side surface of the storage part 1 so as to be vertical with respect to the thickness direction of the coin holder body 9.

FIGS. 2 and 3 show a structure in which the upper and lower plates 5 are fixed to the coin holder body 9 by push rivets or the like using fixing holes 6 for upper and lower plates provided in the upper and lower plates 5.

In consideration of the frequency of use for each coin type, the storage parts that are approximately doubled are appropriately allocated. It is considered appropriate that the number of coins stored per storage part is about 2 to 4. Thus, coin layout is as shown in FIGS. 2 and 3.

The operation is facilitated by making the storage part shallow and using a pushing-out method for taking out the coin. That is, in a state where a coin is stored in the storage part 1, the coin can be easily taken out by inserting a finger through the operational opening space 4 and pushing the coin out toward the aperture 2. Since the storage part 1 is shallow, the operability is improved.

Since the single O-ring can be used as a stopper for a plurality of storage parts, the structure can be simplified.

Since the number of stored coins can be determined in consideration of the frequency of use for each coin type, a more compact coin holder can be designed.

BRIEF DESCRIPTION OF DRAWINGS

Exemplary embodiment(s) of the present invention will be described in detail based on the following figures, wherein.

DESCRIPTION OF EMBODIMENTS

A body structure can be made of plastic injection molding, and upper and lower plates can be made of a thin metal sheet or the like.

The front and back coin layouts can also be in a single row, such as 1×4 instead of multiple rows, such as 2×2.

Example

In Japan at the present time, six types of coins of 1, 5, 10, 50, 100, and 500 yen coins are targets. 1, 10 and 100 yen coins are frequently used, whereas 5, 50 and 500 yen coins are less frequently used.

The 500 yen coin is the largest in size, which is an obstacle to the design for reducing the size of the entire coin holder. In addition, the 500 yen coin is not used very often, and even if you only have one or two coins and put them in your pocket by themselves, the coins are less likely to move than other small coins, and are less likely to make noise when hitting each other, and therefore the 500 yen coin is excluded from the design target of the coin holder.

Figure 1:
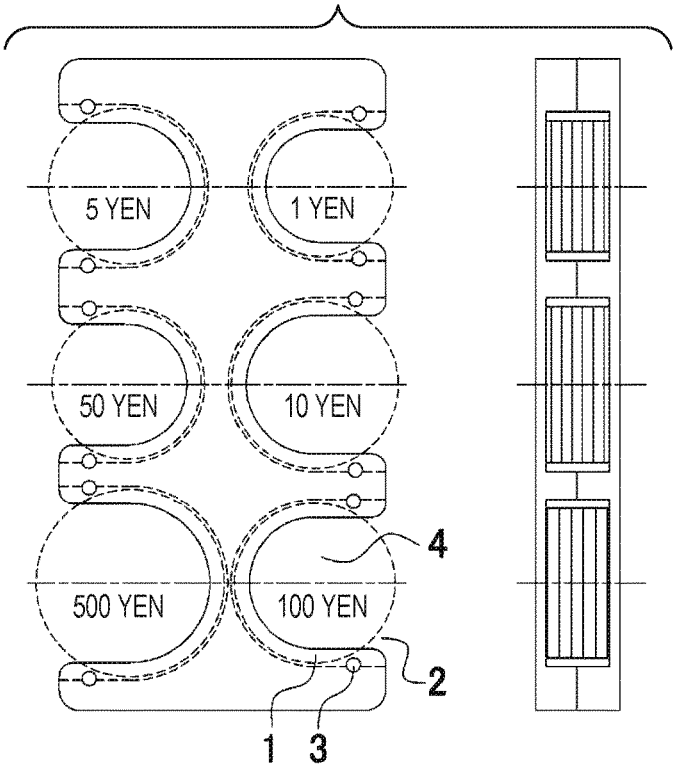
FIG. 1 PRIOR ART
FIG. 1 shows an example of existing coin holder.
Figure 2:
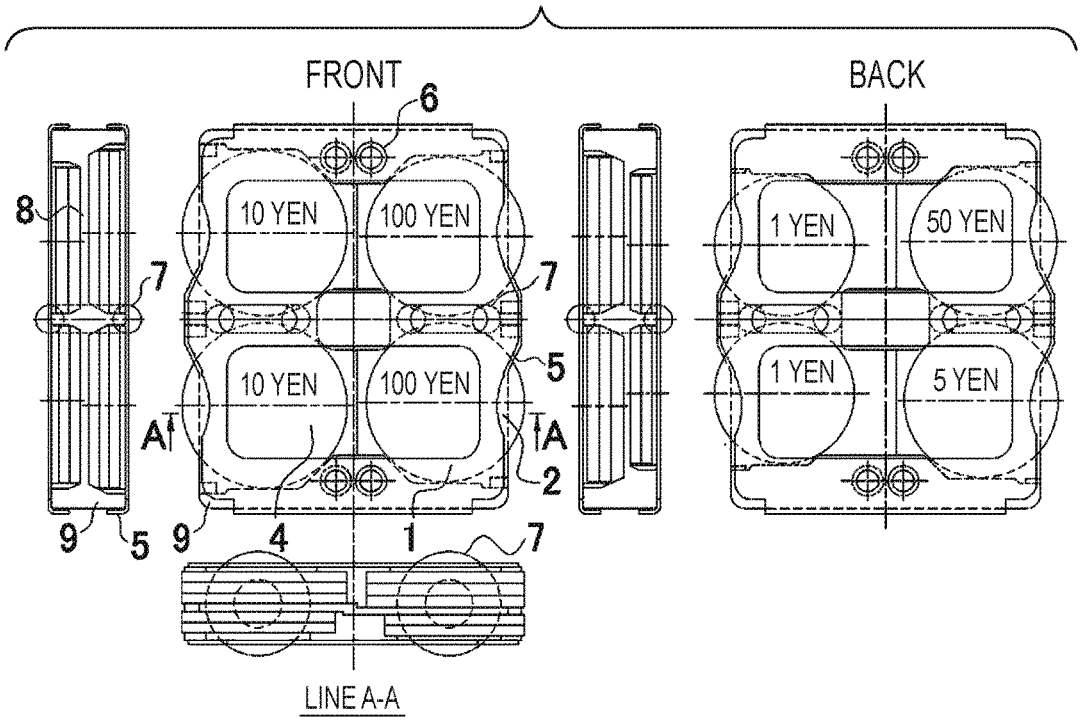
FIG. 2 shows a Japanese coin layout.
Figure 3:
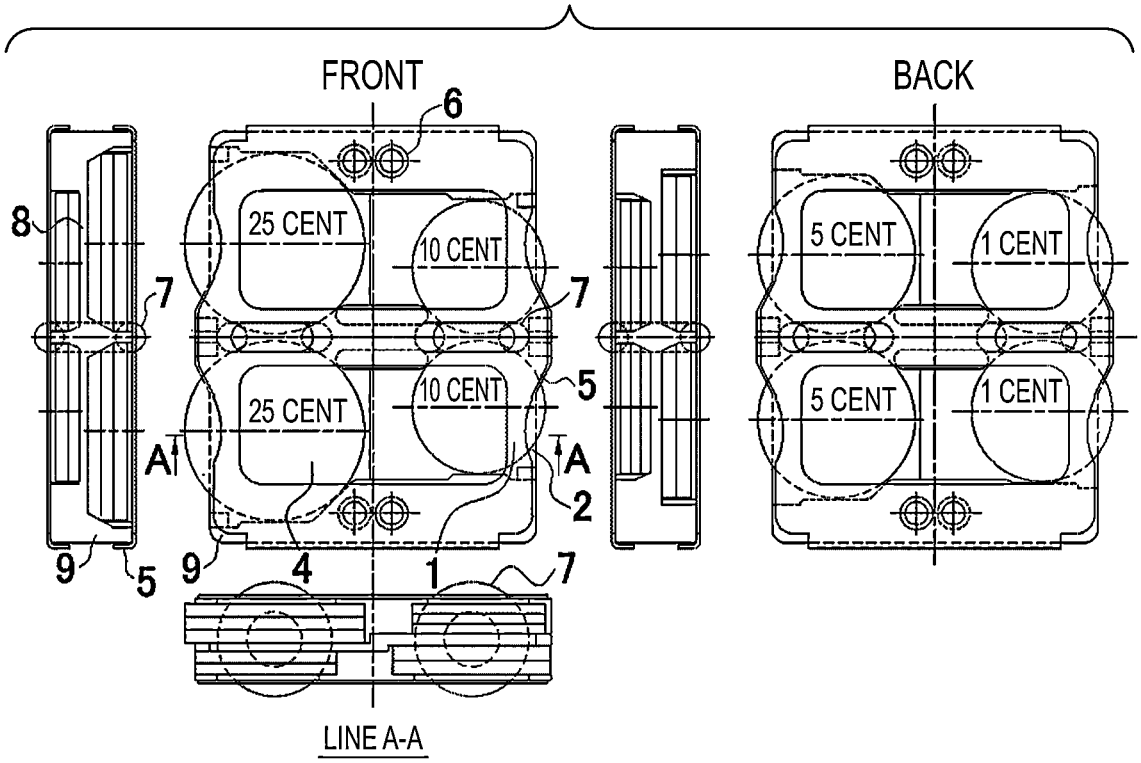
FIG. 3 shows a U.S. coin layout.
Figure 4:
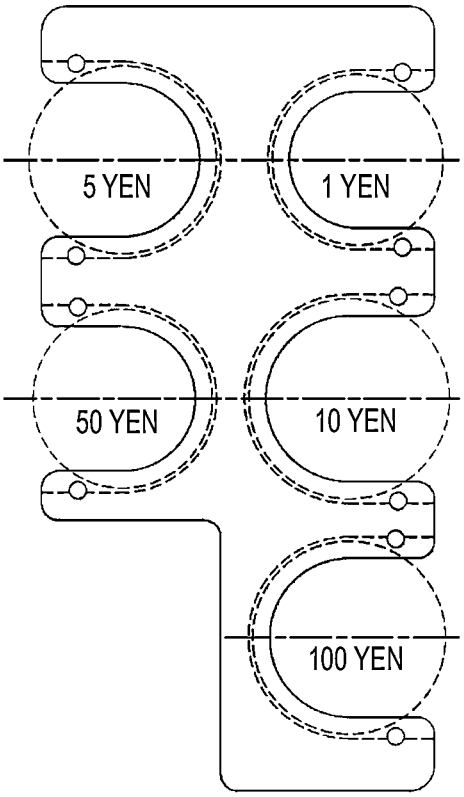
FIG. 4 shows another example of a layout excluding 500 yen coin.

When the 500 yen coin is excluded, there are five types of target coins, and when the coins are simply arranged, the layout of FIG. 1 is as shown in FIG. 4. Accordingly, when the five types of coin storage parts are simply arranged in a 2+3 configuration like this, one type protrudes and fit in poorly compared to a case of a 2×2 configuration, and therefore there are four storage parts on one side (2×2), for a total of eight on the front and back, as shown in FIG. 2. Five types of coins are stored in the storage parts at eight places.

The storage parts at eight places are appropriately allocated in consideration of the frequency of use by coin type. 1, 10 and 100 yen coins are each provided with the two storage parts and 5 and 50 yen coins are each provided with one storage part. It is considered appropriate that the number of coins stored per storage part is 2 to 4. Thus, the coin layout is 10 as shown in FIG. 2.

In the above example, the 500 yen coin is excluded from the storage target, but it is also conceivable to use a small dedicated holder of 500 yen coins alone, attached by a chain or a string. In this method, the 500 yen coin can be stored without making the coin holder body larger. Another coin purse may be attached to hold any remaining coins.

INDUSTRIAL APPLICABILITY

Similar to the existing coin holder, the portable coin holder can be sold for general purposes. The present invention is also applicable to novelties and the like.

Since the more compact the coin holder is, the more convenient it is, the coin holder according to the present invention is highly likely to be widely used.

REFERENCE SIGNS LIST

1 coin storage part, 2 aperture, 3 stopper, 4 operational opening space. 5 upper and lower plates, 6 fixing hole for upper and lower plates, 7 O-ring, 8 partition plate, 9 coin holder body

What is claimed is:

1. A portable coin holder in which coins of plural types are stored by type and from which the coins are taken out by type, the portable coin holder comprising:

a plurality of coins including a first coin and a second coin;

storage parts configured to store the plurality of coins on a front side and a back side of a coin holder body, wherein the storage parts provided on the front side and the back side of the coin holder body are partitioned by a partition plate which is disposed at a substantially intermediate portion in a thickness direction of the coin holder body;

upper and lower plates provided on the front side and the back side of the coin holder body to form the storage parts; and a first operational opening space formed to penetrate the upper plate and a second opening space formed to penetrate the lower plate, wherein two parts for coins of the same type among the storage parts are disposed on one surface which is the front side or the back side of the coin holder body, the first or second operational opening space has a closed circumferential edge, and is provided between a first aperture for placing the first coin into a first storage part among the storage parts and taking out the first coin from the first storage and a second aperture for placing the second coin into a second storage part among the storage parts and taking out the second coin from the second storage part, the second aperture being opposite to the first aperture, in a state where the first coin is placed into the first storage part through the first aperture, the first or second operational opening space is formed over a range at least from a center of the first coin through a rear of the first coin opposite to the first aperture, in a state where the second coin is placed into the second storage part through the second aperture, the first or second operational opening space is formed such that at least a center of the second coin and a rear end of the second coin on a side opposite to the second aperture are exposed from the first or second operational opening space, and the first or second coin is taken out from the first or second storage part by pushing out the first or second coin from the first or second operational opening space.

2. The portable coin holder according to claim 1, wherein an O-ring is provided on at least one side surface of the first or second storage part.

* * * * *